US005527758A

United States Patent [19]

Uyttendaele et al.

[11] Patent Number: 5,527,758

[45] Date of Patent: Jun. 18, 1996

[54] DIRECT THERMAL IMAGING PROCESS WITH IMPROVED TONE REPRODUCTION

[75] Inventors: Carlo Uyttendaele, Mortsel; Herman Uytterhoeven, Bonheiden; Guy Jansen, Borsbeek; Bartholomeus Horsten, Rumst, all of Belgium

[73] Assignee: Agfa-Gevaert N.V., Mortsel, Belgium

[21] Appl. No.: 449,293

[22] Filed: May 24, 1995

[30] Foreign Application Priority Data

Jun. 15, 1994 [EP] European Pat. Off. ..... 94201717

[51] Int. Cl.[6] ..... B41M 5/035; B41M 5/38

[52] U.S. Cl. ..... 503/201; 430/338; 503/202; 503/208; 503/210; 503/211; 503/217; 503/218; 503/225

[58] Field of Search ..... 503/210, 201, 503/211, 217, 218, 208, 209, 225, 202; 430/338, 567, 608, 619

[56] References Cited

U.S. PATENT DOCUMENTS

| | | | |
|---|---|---|---|
| 3,080,254 | 3/1963 | Grant | 117/36.8 |
| 3,094,417 | 6/1963 | Workman | 96/28 |
| 3,795,532 | 3/1974 | Newman et al. | 117/36.2 |
| 4,082,901 | 4/1978 | Laridon et al. | 428/480 |
| 4,173,482 | 11/1979 | Akashi et al. | 430/619 |

*Primary Examiner*—B. Hamilton Hess

*Attorney, Agent, or Firm*—Brumbaugh, Graves, Donohue & Raymond

[57] ABSTRACT

A direct thermal imaging process wherein a non-photosensitive direct thermal recording material is heated dot-wise, and said direct thermal recording material comprises an imaging layer containing uniformly distributed in a film-forming polymeric binder (i) one or more substantially light-insensitive organic silver salts, said silver salt(s) being uniformly in thermal working relationship with (ii) one or more organic reducing agents therefor, however neither including 3,5-dihydroxybenzoic acid as acidic reagent nor di-tert-butyl-p-cresol as a sole reducing agent, characterized in that said imaging layer contains at least one polycarboxylic acid and/or anhydride thereof in a molar percentage of at least 20 with respect to said silver salt(s).

11 Claims, No Drawings

DIRECT THERMAL IMAGING PROCESS WITH IMPROVED TONE REPRODUCTION

DESCRIPTION

1. Field of the Invention

The present invention relates to a direct thermal imaging process for continuous tone reproduction.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.
2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions or incorporated dyes are transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent.

As described in "Handbook of Imaging Materials", edited by Arthur S. Diamond—Diamond Research Corporation—Ventura, Calfornia, printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place.

In a special embodiment of direct thermal imaging a heat-sensitive recording material is used in the form of an electrically resistive ribbon having a multilayered structure in which a carbon-loaded polycarbonate is coated with a thin aluminium film (ref. Progress in Basic Principles of Imaging Systems—Proceedings of the International Congress of Photographic Science Kön (Cologne), 1986 ed. by Friedrich Granzer and Erik Moisar—Friedr. Vieweg & Sohn—Braunschweig/Wiesbaden, FIG. 6. p. 622). Current is injected into the resistive ribbon by electrically addressing a printhead electrode contacting the carbon-loaded substrate, thus resulting in highly localized heating of the ribbon beneath the energized electrode.

The fact that in using a resistive ribbon recording material heat is generated directly in the resistive ribbon and only the travelling ribbon gets hot (not the printheads) an inherent advantage in printing speed is obtained. In applying the thermal printhead technology the various elements of the thermal printhead get hot and must cool down before the printhead can print without cross-talk in a next position.

In another embodiment of direct thermal imaging the recording material is image-wise or pattern-wise heated by means of a modulated laser beam. For example, image-wise modulated infra-red laser light is absorbed in the recording layer in infra-red light absorbing substances converting infra-red radiation into the necessary heat for the imaging reaction.

The imagewise applied laser light has not necessarily to be infrared light since the power of a laser in the visible light range and even in the ultraviolet region can be thus high that sufficient heat is generated on absorption of the laser light in the recording material. There is no limitation on the kind of laser used which may be a gas laser, gas ion laser, e.g. argon ion laser, solid state laser, e.g. Nd:YAG laser, dye laser or semi-conductor laser.

The use of an infrared light emitting laser and a dye-donor element containing an infrared light absorbing material is described e.g. in U.S. Pat. No. 4,912,083. Suitable infra-red light absorbing dyes for laser-induced thermal dye transfer are described e.g. in U.S. Pat. No. 4,948,777, which US-P documents for said dyes and lasers applied in direct thermal imaging have to be read in conjunction herewith.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Existing direct thermographic recording materials based on the use of organic silver salts such as silver behenate as sole imaging substances providing on reduction metallic silver in the absence of other imaging substances such as leuco dyes are, when image-wise heated with a thermal printhead, normally not suited for reproducing images with sufficiently high optical density (more than 2.5) and fairly large number of grey levels as is required for continuous tone reproduction.

A thermographic recording material according to U.S. Pat. No. 4,904,572 contains a polymeric binder, di- or triarylmethane thiolactone dye precursor in combination with silver behenate and 3,5-dihydroxybenzoic acid as an organic acidic reagent. Said reagent acts as a weak reducing agent and provides a stable one-pot coating composition. Other organic acidic reagents such as phthalic acid are described in column 6 of said US-P.

In Polish patent specification 99,906 published Oct. 15, 1979 a heat-sensitive paper has been described for use in combination with a light-sensitive recording material wherefrom photographically non-destroyed reducing agent is transferred thermally into said thermosensitive paper. That recording system is commercially known under the tradename DUAL SPECTRUM of 3M Company. In said heat-sensitive paper di-tert-butyl-p-cresol is uniformly distributed in conjunction with silver behenate and a solid dicarboxylic acid with a melting point of 120°–160° C., which acid according to an example is adipic acid used in an amount of 10 g with respect to 10 g of silver behenate. According to said specification the applied method provides copies with clear black lines on a background that does not changes color even when heated to a temperature of above ±50° C. during 2 h.

According to published European patent application No. 0 622 217 A1 relating to a method for making an image using a direct thermal imaging element, improvements in continuous tone reproduction are obtained by heating a direct thermal recording element by means of a printhead having a plurality of heating elements, characterized in that the activation of the heating elements is executed line by line with a duty cycle Δ representing the ratio of activation time to total line time in such a way that the following equation is satisfied:

$$P \leqq P_{max} = 3.3\ W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

Although by controlling the heating of the heating elements of a thermal head in the way as described in said EP-A already an improvement in continuous tone reproduction is obtained, further improvements to lower the image gradation are still desirable from the side of the composition of the thermal recording element.

Apart from the need of a relatively low image gradation in continuous tone reproduction it has been found experimentally by us that the "banding" structure in the image becomes less visible when lowering the gradation of the image reproduction. Banding is a phenomenon characterized by the presence in the thermographic image of parallel stripes of different optical density in the print direction and is typical for the use of thermal printheads containing an array of geometrically juxtaposed heating resistors that may show a spread in resistance value and/or contact-pressure with the recording material.

OBJECTS AND SUMMARY OF THE INVENTION

It is an object of the present invention to provide a direct thermal imaging process operating with a thermal printhead in conjunction with a heat-sensitive recording material capable of yielding images with maximum density higher than 2.5 and gradation sufficiently low for continuous tone reproduction as is needed e.g. in portrait reproduction for identification documents and in the medical diagnostic field based on images produced by e.g. radiography, ultrasound or nuclear magnetic resonance (NMR) signals.

It is a further object of the present invention to provide a direct thermal imaging process operating with a thermal printhead in conjunction with a heat-sensitive recording material capable of yielding images substantially free from banding structure.

Other objects and advantages of the present invention will appear from the further description.

In accordance with the present invention a direct thermal imaging process is provided wherein a non-photosensitive direct thermal recording material is heated dot-wise, and said direct thermal recording material comprises an imaging layer containing uniformly distributed in a film-forming polymeric binder (i) one or more substantially light-insensitive organic silver salts, said silver salt(s) being uniformly in thermal working relationship with (ii) one or more organic reducing agents therefor, however neither including 3,5-dihydroxybenzoic acid as acidic reagent nor di-tert-butyl-p-cresol as a sole reducing agent, characterized in that said imaging layer contains at least one polycarboxylic acid and/or anhydride thereof in a molar percentage of at least 20 with respect to said silver salt(s).

Said mole percentage is preferably in the range of 20 to 30.

By "thermal working relationship" is meant here that said substantially light-insensitive silver salt and said organic reducing agent can react by means of heat to form metallic silver. For that purpose said ingredients (i) and (ii) may be present in the same binder-containing layer or in different layers wherefrom by heat they can come into reactive contact with each other, e.g. by diffusion or sublimation.

DETAILED DESCRIPTION OF THE INVENTION

For evaluating the tone reproduction capabilities of a direct thermal recording material the numerical gradation value (NGV) corresponding with the quotient of the following fraction: $(2.5-0.1)/(E_{2.5}-E_{0.1})$ is determined; herein $E_{2.5}$ is the minimal energy in Joule applied in a dot area of 87 μm×87 μm of the recording material that obtains by said energy an optical density value of 2.5, and $E_{0.1}$ is the maximal energy in Joule applied in a dot area of the recording material that obtains by said energy an optical density value of 0.1. Said optical density values are values above the inherent optical density of the "unheated" recording material having always already some optical density by the inherent optical density of the imaging layer and its support.

In the obtaining of optical densities 0.1 to 2.5 on the recording material solid area are printed with a thermal head printer developed for thermosensitometric measurement purposes and having distinct groups of micro-resistors being arranged in succession along the width of the printhead array. From group to group said resistors receive a linearly increasing amount of electrical energy within the line time of the printer. The input of electrical energy per group of resistors is controlled by linearly increasing the period of time from group to group wherein a constant current at constant voltage is applied, said current and voltage being kept constant over the whole printing period.

By definition the line time is the time needed for printing one single line with the thermal head. In the here for thermosensitometric purposes applied thermal head printer the line time is a period of time of 32 ms wherein the imaging material with respect to the print array travels a distance of one pixel length, viz. 87 μm.

The continuous tone reproduction capability of a heat-sensitive imaging material used according to the present invention is favoured by a relatively high binder to silver salt weight ratio in the imaging layer. Preferably said ratio is in the range of 1/2 to 6/1 and more preferably from 1/1 to 4/1.

Substantially light-insensitive organic silver salts particularly suited for use in a direct thermal recording material according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps" Modified aliphatic carboxylic acids with thioether group as described e.g. in GB-P 1,111,492 and other organic silver salts as described in GB-P 10,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Organic reducing agents suitable for use according to the present invention, i.e. for the reduction of substantially light-insensitive organic silver salts, are aromatic di- and tri-hydroxy compounds having at least two hydroxy groups in ortho- or para-position on the same aromatic nucleus, e.g. benzene nucleus, more particularly e.g. hydroquinone and substituted hydroquinones, catechol, pyrogallol, gallic acid and gallic acid esters. Particularly useful are polyhydroxy spiro-bis-indane compounds, especially these corresponding to the following general formula:

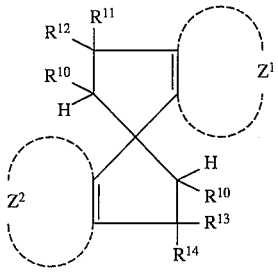

wherein $R^{10}$ represents hydrogen or alkyl, e.g. methyl or ethyl, each of $R^{11}$ and $R^{12}$ (same or different) represents H, an alkyl group, e.g. methyl, ethyl or propyl, an alkenyl group or a cycloalkyl group, e.g. cyclohexyl group, or $R^{11}$ and $R^{12}$ together represent the atoms necessary to close a homocyclic non-aromatic ring, e.g. a cylohexyl ring, each of $R^{13}$ and $R^{14}$ (same or different) represents H, an alkyl group, e.g. methyl, ethyl or propyl, an alkenyl group or a cycloalkyl group, e.g. cyclohexyl group, or $R^{13}$ and $R^{14}$ together represent the atoms necessary to close a homocyclic non-aromatic ring, e.g. cyclohexyl, each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

In particular are mentioned the polyhydroxy-spiro-bis-indane compounds described in U.S. Pat. No. 3,440,049 as photographic tanning agent, more especially 3,3,3',3'-tetramethyl-5,6,5', 6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II). Indane is also known under the name hydrindene.

Preferred are catechol-type reducing agents, by which is meant reducing agents containing at least one benzene nucleus with two hydroxy groups (—OH) in ortho-position, e.g. catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters.

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive silver salt such as silver behenate, or are bisphenols, e.g. of the type described in U.S. Pat. No. 3,547,648. The auxiliary reducing agents may be present in the imaging layer or in a polymeric binder layer adjacent thereto.

In particular the presence of polycarboxylic acid(s) and/or anhydrides thereof in thermal working relationship with the substantially light-insensitive silver salt has an image gradation-lowering effect as can be learned from the Examples.

The polycarboxylic acid may be aliphatic (saturated as well as unsaturated aliphatic and likewise cycloaliphatic) as well as an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g.: succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are: maleic acid, citraconic acid, iraconic acid and aconitic acid. A particularly effectively gradation lowering substituted polycarboxylic acid is citric acid, and derivative thereof acetonedicarboxylic acid and further iso-citric acid and α-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

The silver image density depends on the coverage of said substantially light-insensitive silver salts in combination with said polycarboxylic acids and reducing agent(s) and has to be preferably such that, on heating above 120° C., an optical density of at least 2.5 can be obtained.

The thickness of the imaging layer is preferably in the range of 5 to 50 μm.

According to a special embodiment said substantially light-insensitive organic silver salt and said organic reducing agent are present in different layers wherefrom by heat they can come into reactive contact with each other.

The film-forming water-insoluble polymeric binder of the imaging layer of the present direct thermal recording material is preferably a thermoplastic resin or mixture of such resins, wherein the silver salt can be dispersed homogeneously. For that purpose all kinds of natural, modified natural or synthetic water-insoluble resins may be used, e.g. cellulose derivatives such as ethylcellulose, cellulose esters, e.g. cellulose nitrate, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters and polyethylene or mixtures thereof.

A particularly suitable polyvinyl butyral containing a minor amount of vinyl alcohol units is marketed under the tradename BUTVAR B79 of Monsanto USA and provides a good adherence to paper and properly subbed polyester supports.

The layer containing the organic silver salt is commonly coated from an organic solvent containing the binder in dissolved form.

The binder of the imaging layer may be combined with waxes or "heat solvents" also called "thermal solvents" or "thermosolvents" improving the reaction speed of the redox-reaction at elevated temperature.

By the term "heat solvent" in this invention is meant a nonhydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

In order to obtain a neutral black image tone in the higher densities and neutral grey in the lower densities the recording layer contains in admixture with said organic silver salt and reducing agents a so-called toning agent known from thermography or photo-thermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula:

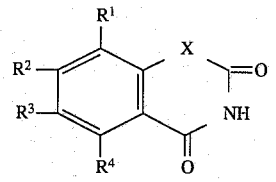

in which:

X represents O or N-alkyl;

each of $R^1$, $R^2$, $R^3$ and $R^4$ (same or different) represents hydrogen, alkyl, e.g. C1-C20 alkyl, preferably C1-C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of said general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

In addition to said ingredients the imaging layer may contain other additives such as free fatty acids, antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, and/or optical brightening agents.

The support for the heat-sensitive recording material according to the present invention is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated heat-sensitive imaging layer.

The coating of the imaging layer may proceed by any coating technique e.g. as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Direct thermal imaging can be used for both the production of transparencies and reflection type prints. Such means that the support may be transparent or opaque, e.g. the support has a white light reflecting aspect. For example, a paper base is used which may contain white light reflecting pigments, optionally also applied in an interlayer between the recording layer and said base. In case a transparent base is used, said base may be colourless or coloured, e.g. has a blue colour.

In the hard copy field recording materials on white opaque base are used, whereas in the medical diagnostic field black-imaged transparencies find wide application in inspection techniques operating with a light box.

The recording materials of the present invention are particularly suited for use in thermographic recording techniques operating with thermal print-heads. Suitable thermal printing heads are e.g. a Fujitsu Thermal Head (FTP-040 MCS001), a TDK Thermal Head F415 HH7-1089, and a Rohm Thermal Head KE 2008-F3.

In a special embodiment in order to avoid direct contact of the printheads with the outermost layer of the recording material, the imagewise heating of the recording material with said printheads proceeds through a contacting but removable resin sheet or web wherefrom during said heating no transfer of imaging material can take place.

The imaging layer when being the outermost layer may contain hydrophilic finely divided (colloidal) optically transparent inert inorganic pigments such as transparent colloidal silica not masking the lateron formed silver image.

In an other embodiment in order to improve resistance against abrasion which may occur by frictional contact with the printheads, the imaging layer is coated with a protective coating and/or contains substances having anti-sticking properties e.g. (a) lubricating agent(s). Thus, the outermost layer of the heat-sensitive recording material according to the present invention may comprise a dissolved lubricating material and/or a dispersed particulate lubricating material, e.g. talc particles, optionally protruding from the outermost layer. Examples of suitable lubricating materials are a surface active agent, a liquid lubricant, a solid lubricant or mixtures thereof.

The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$-$C_{20}$ aliphatic acids. Examples of liquid lubricants include silicone oils, synthetic oils, saturated hydrocarbons and glycols. Examples of solid organic lubricants include various higher alcohols such as stearyl alcohol, fatty acids and fatty acid esters.

As examples of outermost slipping layers are mentioned layers made from a styrene-acrylonitrile copolymer or a styrene-acrylonitrile-butadiene copolymer or binder mixture hereof containing as lubricant in an amount of 0.1 to 10% by weight with respect to said binder(s) a polysiloxane-polyether copolymer or polytetrafluoroethylene or a mixture hereof.

Another suitable outermost slipping layer may be obtained by coating a solution of at least one silicon compound and a substance capable of forming during the coating procedure a polymer having an inorganic backbone which is an oxide of a group IVa or IVb element as described in published European patent application 0554576.

Other suitable protective layer compositions that may be applied as slipping (anti-stick) coating are described e.g. in published European patent applications (EP-A) 0 501 072 and 0 492 411.

The following examples illustrate the present invention. The percentages, parts and ratios are by weight unless otherwise indicated.

EXAMPLE 1 (COMPARATIVE EXAMPLE)

Thermosensitive recording materials A1–A6

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 5.30 g/m$^2$ |
| polyvinyl butyral (BUTVAR B79-tradename) | 5.30 g/m$^2$ |
| ethyl gallate | 1.18 g/m$^2$ |
| 3,4-dihydro-2,4-dioxo-1,3,2H-benzoxazine | 0.39 g/m$^2$ |
| 3-nitro-phthalic acid ((NPA) in g/m$^2$ (see Table 1) | |

Printing

For the purpose of determining tone (grey value range) reproduction capabilities on the recording materials solid area are printed with a thermal head printer developed for thermosensitometric measurement purposes and having distinct groups of micro-resistors being arranged in succession along the width of the printhead array. From group to group said resistors receive a linearly increasing amount of electrical energy within the line time of the printer.

The input of electrical energy per group of resistors is controlled by linearly increasing the period of time from group to group wherein a constant current at constant voltage is applied, said current and voltage being kept constant over the whole printing period. In the applied thermal head printer the line time is a period of time of 32 ms wherein the imaging material with respect to the print array travels a distance of a pixel length of 87 μm.

During printing the print head was separated from the imaging layer by a thin intermediate material and made contact with the slipping layer of a separatable intermediate 5 μm thick polyethylene terephthalate ribbon being coated in consecutive order with a subbing layer, heat-resistant layer and said slipping layer (anti-friction layer) giving the ribbon a total thickness of 6 μm.

Said subbing layer, also called primer layer, is a layer of a copolyester being a polycondensation product of ethylene glycol, adipic acid, neopentyl glycol, terephthalic acid, isophthalic acid and glycerol. On this subbing layer, a heat-resistant layer has been coated from methyl ethyl ketone containing a polycarbonate having the following structure and being applied at a coverage of 0.5 g/m$^2$:

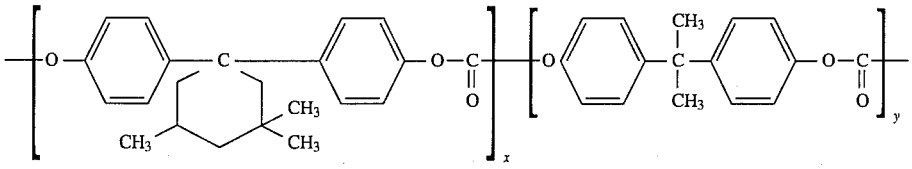

wherein x=55 mol % and y=45 mol %.

On top of said polycarbonate layer an outermost slipping layer of polyether modified polydimethylsiloxane (TEGOGLIDE 410, tradename of T. H. Goldschmidt) has been applied at 0.07 g/m$^2$ from isopropanol.

Evaluation

For evaluating the tone reproduction capabilities of the above thermosensitive recording materials A1 to A6 the numerical gradation value (NGV) corresponding with the quotient of the fraction $(2.5-0.1)/(E_{2.5}-E_{0.1})$ was determined; herein $E_{2.5}$ is the energy in Joule applied in a dot area of 87 μm×87 μm of the imaging layer that obtains by said energy an optical density value of 2.5, and $E_{0.1}$ is the energy in Joule applied in a dot area of the imaging layer material that obtains by said energy an optical density value of 0.1. The applied energy in Joule is actually the electrical input energy measured for each resistor of the thermal head.

The obtained NGV values and further information about the composition of the recording materials A1 to A6 is given in Table 1.

TABLE 1

| Material | NPA g/m$^2$ | mole % of acid to silver behenate | NGV |
|---|---|---|---|
| A1 | none | — | 7.82 |
| A2 | 0.126 | 5 | 7.82 |
| A3 | 0.252 | 10 | 6.81 |
| A4 | 0.378 | 15 | 6.04 |
| A5 | 0.504 | 20 | 5.15 |
| A6 | 0.756 | 30 | 3.92 |

The recording materials A5 and A6 are invention materials, the other ones are comparative test materials.

As can be learned from said Table 1 a substantial lowering of gradation expressed by said numerical gradation value (NGV) is obtained with recording materials containing NPA and silver behenate in a mole/mole ratio of 0.20 and more.

EXAMPLE 2 (COMPARATIVE EXAMPLE)

Thermosensitive recording materials B1–B6

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 5.00 g/m$^2$ |
| polyvinyl butyral (BUTVAR B79-tradename) | 8.00 g/m$^2$ |
| ethyl gallate | 3.20 g/m$^2$ |
| 3,4-dihydro-2,4-dioxo-1,3,2H-benzoxazine | 0.36 g/m$^2$ |
| ortho-phthalic acid ((OPA) in g/m$^2$ (see Table 2) | |

Printing and evaluation proceeded as described in Example 1.

TABLE 2

| Material | OPA g/m$^2$ | mole % of acid to silver behenate | NGV |
|---|---|---|---|
| B1 | none | — | 7.60 |
| B2 | 0.126 | 8 | 8.10 |
| B3 | 0.252 | 16 | 10.00 |
| B4 | 0.378 | 24 | 6.50 |
| B5 | 0.504 | 32 | 4.20 |

The recording materials B4 and B5 are invention materials whereas the recording materials B1 to B3 are "non-invention" comparative test materials.

EXAMPLE 3 (COMPARATIVE EXAMPLE)

Thermosensitive recording materials C1–C3

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 4.50 g/m$^2$ |
| polyvinyl butyral (BUTVAR B79-tradename) | 17.60 g/m$^2$ |
| n-butyl ester of 3,4-dihydroxy-benzoic acid | 1.06 g/m$^2$ |
| 3,4-dihydro-2,4-dioxo-1,3,2H-benzoxazine | 0.33 g/m$^2$ |
| pimelic acid (PIA) in g/m$^2$ (see Table 3) | |
| BAYSILON Ö1 A (tradename of BAYER AG) | 20 mg/m$^2$ |

Printing and evaluation proceeded as described in Example 1. Material C0 is the "blanco" material free from polyacid.

TABLE 3

| Material | PIA g/m$^2$ | mole % of acid to silver behenate | NGV |
|---|---|---|---|
| C0 | none | — | 3.10 |
| C1 | 0.140 | 9 | 3.50 |
| C2 | 0.280 | 18 | 3.10 |
| C3 | 0.440 | 27.5 | 2.00 |

The recording material C3 is an invention material whereas the recording materials C1 and C2 are "non-invention" comparative test materials.

EXAMPLE 4 (COMPARATIVE EXAMPLE)

Thermosensitive recording materials D1–D3

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 4.50 g/m$^2$ |
| polyvinyl butyral (BUTVAR B79-tradename) | 17.60 g/m$^2$ |
| n-butyl ester of 3,4-dihydroxy-benzoic acid | 1.06 g/m$^2$ |
| 3,4-dihydro-2,4-dioxo-1,3,2H-benzoxazine | 0.33 g/m$^2$ |
| ortho-phthalic acid (OPA) in g/m$^2$ (see Table 4) | |
| BAYSILON Ö1 A (tradename of BAYER AG) | 20 mg/m$^2$ |

Printing and evaluation proceeded as described in Example 1. Material C0 is the "blanco" material free from polyacid.

TABLE 4

| Material | OPA g/m$^2$ | mole % of acid to silver behenate | NGV |
|---|---|---|---|
| D0 | none | — | 3.10 |
| D1 | 0.150 | 9 | 3.40 |
| D2 | 0.300 | 18 | 3.00 |
| D3 | 0.460 | 27.5 | 1.80 |

The recording material D3 is an invention material whereas the recording materials D1 and D2 are "non-invention" comparative test materials.

EXAMPLE 5 (COMPARATIVE EXAMPLE)

Thermosensitive recording materials E1–E4

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 5.30 g/m$^2$ |
| polyvinyl butyral (BUTVAR B79-tradename) | 5.30 g/m$^2$ |
| ethyl gallate | 1.18 g/m$^2$ |
| 3,4-dihydro-2,4-dioxo-1,3,2H-benzoxazine | 0.39 g/m$^2$ |
| ortho-phthalic acid ((OPA) or benzoic acid (BA) in g/m$^2$ (see Table 5) | |

Printing and evaluation proceeded as described in Example 1.

TABLE 5

| Material | OPA g/m$^2$ | BA g/m$^2$ | mole % of acid to silver behenate | NGV |
|---|---|---|---|---|
| E1 | none | none | — | 7.82 |
| E2 | none | 0.47 | 30 | 8.00 |
| E3 | none | 0.95 | 60 | 8.10 |
| E4 | 0.59 | none | 30 | 4.30 |

The recording material E4 is an invention materials, the other ones are "non-invention" comparative test materials.

As can be learned from said Table 5 benzoic acid being a monocarboxylic acid even when being used in a same equivalent amount of carboxylic acid groups as the ortho-phthalic acid does not yield a lowering of the gradation as expressed by numerical gradation value (NGV).

EXAMPLE 6 (COMPARATIVE EXAMPLE)

Thermosensitive recording materials F1–F2

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 4.50 g/m$^2$ |
| polyvinyl butyral (BUTVAR B79-tradename) | 17.60 g/m$^2$ |
| n-butyl ester of 3,4-dihydroxy-benzoic acid | 1.06 g/m$^2$ |
| 3,4-dihydro-2,4-dioxo-1,3,2H-benzoxazine | 0.33 g/m$^2$ |
| pimelic acid (PIA) and o-phthalic acid (OPA) in g/m$^2$ (see Table 6) | |
| BAYSILON Ö1 A (tradename of BAYER AG) | 20 mg/m$^2$ |

Printing and evaluation proceeded as described in Example 1. Material E0 is a blanco material free from polyacid.

TABLE 6

| Material | PIA g/m$^2$ | OPA g/m$^2$ | mole % of acid to silver behenate | NGV |
|---|---|---|---|---|
| E0 | none | none | — | 3.1 |
| E1 | 0.44 | none | 27.5 | 2.0 |
| E2 | 0.23 | 0.24 | (14 + 14) | 2.3 |

The recording material E1 and E2 are invention materials.

EXAMPLE 7 (COMPARATIVE EXAMPLE)

Thermosensitive recording materials G1–G3

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 5.30 g/m$^2$ |
| polyvinyl butyral (BUTVAR B79-tradename) | 5.30 g/m$^2$ |
| ethyl gallate | 1.18 g/m$^2$ |
| 3,4-dihydro-2,4-dioxo-1,3,2H-benzoxazine | 0.39 g/m$^2$ |
| pimelic acid (PIA) or adipic acid (ADI) or sebacic acid (SEBA) in g/m$^2$ (see Table 7) | |

Printing and evaluation proceeded as described in Example 1.

TABLE 7

| Material | PIA g/m$^2$ | ADI g/m$^2$ | SEBA g/m$^2$ | mole % of acid to silver behenate | NGV |
|---|---|---|---|---|---|
| G0 | none | none | none | — | 7.82 |
| G1 | 0.52 | none | none | 27.5 | 3.30 |

TABLE 7-continued

| Material | PIA g/m$^2$ | ADI g/m$^2$ | SEBA g/m$^2$ | mole % of acid to silver behenate | NGV |
|---|---|---|---|---|---|
| G2 | none | 0.48 | none | 27.5 | 3.20 |
| G3 | none | none | 0.66 | 27.5 | 3.20 |

The recording materials G1 to G3 are invention materials.

EXAMPLE 8 (COMPARATIVE EXAMPLE)

Thermosensitive recording materials X1–X6

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing per m$^2$:

| | |
|---|---|
| silver behenate | 4.50 g |
| polyvinyl butyral (BUTVAR B79-tradename) | see Table X |
| adipic acid (AA) | see Table X |
| 3,4-dihydro-2,4-dioxo-1,3,2H-benzoxazine | 0.33 g/m$^2$ |
| tetrachlorophthalic anhydride (TCFA) | see Table X |
| reducing agent | see Table X |
| BAYSILON Ö1 A (tradename of BAYER AG) | 20 mg |

Printing and evaluation proceeded as described in Example 1.

TABLE X

| EXAMPLE | X1 | X2 | X3 | X4 | X5 | X6 |
|---|---|---|---|---|---|---|
| BUTVAR B79 (tradename) (g/m$^2$) | 4.5 | 4.5 | 4.5 | 17.6 | 17.6 | 17.6 |
| AA (g/m$^2$) | nil | nil | nil | 0.33 | 0.33 | 0.33 |
| (mole % acid to Ag-behenate) | | | | 22.5 | 22.5 | 22.5 |
| TCFA (g/m$^2$) | nil | nil | nil | 0.14 | 0.14 | 0.14 |
| (mole % acid to AG-behenate | | | | 5.0 | 5.0 | 5.0 |
| Reducing agent: | | | | | | |
| n-butylester of 3,4-dihydroxy-benzoic acid | 1.06 | nil | nil | 1.06 | nil | nil |
| di-tert-butyl-p-cresol | nil | 2.21 | nil | nil | 2.21 | nil |
| 3,5-dihydroxybenzoezuur | nil | nil | 0.78 | nil | nil | 0.78 |
| PRINTING RESULTS | | | | | | |
| Dmin | 0.06 | 0.06 | 0.07 | 0.07 | 0.07 | 0.08 |
| Dmax | 2.95 | 0.11 | 0.78 | 3.04 | 0.08 | 0.71 |
| NGV | 3.10 | nil | nil | 2.00 | nil | nil |

As can be learned from the above Table X only the recording materials X1 (non-invention material) and X4 (invention material) yielded a maximum optical density (Dmax) larger than 2.5. The numerical gradation (NGV) expressed as defined herein (see Example 1) is much higher for the non-invention material X1 than for invention material X4.

The maximum optical density (Dmax) obtainable with di-tert-butyl-p-cresol or 3,5-dihydroxy benzoic acid as sole reducing agents is too low for defining the numerical gradation value NGV (see non-invention recording materials X2, X3, X5 and X6). The optical background density, also called minimum density (Dmin) is practically the same for all of the recording materials X1–X6.

We claim:

1. A direct thermal imaging process wherein a non-photosensitive direct thermal recording material is heated dot-wise, and said direct thermal recording material comprises an imaging layer containing uniformly distributed in a film-forming polymeric binder (i) one or more substantially light-insensitive organic silver salts, said silver salt(s) being uniformly in thermal working relationship with (ii) one or more organic reducing agents therefor, however neither including 3,5-dihydroxybenzoic acid as acidic reagent nor di-tert-butyl-p-cresol as a sole reducing agent, characterized in that said imaging layer contains at least one polycarboxylic acid and/or anhydride thereof in a molar percentage of at least 20 with respect to said silver salt(s).

2. Recording process according to claim 1, wherein said molar percentage is in the range of 20 to 30.

3. Recording process according to claim 1, wherein said substantially light-insensitive organic silver salt is a silver salt of an aliphatic carboxylic acid having at least 12 C-atoms and being selected from the group consisting of silver palmitate, silver stearate and silver behenate.

4. Recording process according to claim 1, wherein said reducing agent is a polyhydroxybenzine reducing agent.

5. Recording process according to claim 1, wherein said reducing agent is a member selected from the group consisting of catechol, 3-( 3,4-dihydroxyphenyl) propionic acid, 1,2-dihydroxybenzoic acid, gallic acid and esters, tannic acid, 3,4-dihydroxy-benzoic acid esters, and polyhydroxyspiro-bis-indane compounds.

6. Recording process according to claim 10 wherein said polycarboxylic acid or anhydride thereof is an aliphatic or aromatic polycarboxylic acid optionally substituted with alkyl, hydroxyl, nitro or halogen.

7. Recording process according to claim 1, wherein said polycarboxylic acid is a member selected from the group consisting of succinic acid, glutaric acid, adipic acid, pimelic acid, suberic acid, azelaic acid, sebacic acid, nonane-dicarboxylic acid, decane-dicarboxylic acid, undecane-dicarboxylic acid, maleic acid, citraconic acid, iraconic acid, aconitic acid, citric acid, acetonedicarboxylic acid, iso-citric acid, α-ketoglutaric acid, ortho-phthalic acid, 3-nitro-phthalic acid, tetrachlorophthalic acid, mellitic acid, pyromellitic acid and trimellitic acid and the anhydrides thereof.

8. Recording process according to claim 1, wherein the recording layer contains in admixture with said silver salt at least one toning agent being a phthalimide, phthalazinone or heterocyclic compound corresponding to following general formula:

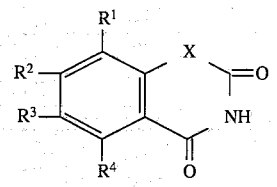

in which:

X represents O or N-alkyl;

each of $R^1$, $R^2$, $R^3$ and $R^4$ (same or different) represents hydrogen, alkyl, cycloalkyl, alkoxy, alkylthio, hydroxy, dialkylamino or halogen: or $R^1$ and $R^2$ or $R^2$ and $R^3$ together represent the ring members required to complete a fused aromatic ring, or $R^3$ and $R^4$ together represent the ring members required to complete a fused aromatic aromatic or cyclhexane ring.

9. Recording process according to claim 1, wherein the binder to silver salt weight ratio in the imaging layer is in the range of 1/2 to 6/1.

10. Recording process according to claim 1, wherein said binder is a polyvinylbutyral.

11. Recording process according to claim 1, wherein said substantially light-insensitive organic silver salt and said organic reducing agent are present in different layers wherefrom by heat they can come into reactive contact with each other.

* * * * *

UNITED STATES PATENT AND TRADEMARK OFFICE

CERTIFICATE OF CORRECTION

PATENT NO. : 5,527,758

DATED : June 18, 1996

INVENTOR(S) : Uyttendaele et al.

It is certified that error appears in the above-indentified patent and that said Letters Patent is hereby corrected as shown below:

Column 1, line 67, "Kön" should read --Köln--;

Column 3, line 7, "changes" should read --change--;

Column 5, line 4, "10,439,478" should read --1,439,478--;

Column 6, line 24, "iraconic" should read --itaconic--;

Column 15, line 33, "claim 10" should read --claim 1,--;

Column 15, last line, "iraconic" should read --itaconic--.

Signed and Sealed this

Fifth Day of November, 1996

Bruce Lehman

*Attest:*

BRUCE LEHMAN

*Attesting Officer*

*Commissioner of Patents and Trademarks*